US009226563B2

(12) United States Patent
Silva

(10) Patent No.: US 9,226,563 B2
(45) Date of Patent: Jan. 5, 2016

(54) COSMETIC APPLICATION TOOL AND CONTAINER SYSTEM AND METHOD

(71) Applicant: Readeeming Beauty, Inc., Bethlehem, PA (US)

(72) Inventor: Rea Ann Silva, Encino, CA (US)

(73) Assignee: Rea.deeming Beauty, Inc., Bethlehem, PA (US)

( * ) Notice: Subject to any disclaimer, the term of this patent is extended or adjusted under 35 U.S.C. 154(b) by 0 days.

(21) Appl. No.: 14/176,849

(22) Filed: Feb. 10, 2014

(65) Prior Publication Data

US 2014/0305466 A1 Oct. 16, 2014

Related U.S. Application Data

(60) Provisional application No. 61/762,789, filed on Feb. 8, 2013.

(51) Int. Cl.

| | |
|---|---|
| ***A45D 40/24*** | (2006.01) |
| ***A45D 33/24*** | (2006.01) |
| ***A45D 33/26*** | (2006.01) |
| ***A45D 44/00*** | (2006.01) |

(52) U.S. Cl.

CPC ..... *A45D 44/005* (2013.01); *A45D 40/24* (2013.01); *A45D 2200/052* (2013.01); *A45D 2200/25* (2013.01)

(58) Field of Classification Search

CPC ..... A45D 40/00; A45D 40/0068; A45D 40/0087; A45D 40/24; A45D 2040/0006; A45D 2040/0012; A45D 2200/05; A45D 2200/052; A45D 2200/058; A45D 2200/25; A45D 29/18; A45D 29/20; A45D 33/00; A45D 33/006; A45D 33/18; A45D 33/22; A45D 33/26; A45D 2033/001; A45D 34/00; A45D 2034/002; A45D 2034/007; A45D 44/005; A45C 11/008; A45C 13/02

USPC ..... 132/314, 200, 212, 73, 286, 294, 317, 132/318, 319, 333; 206/581, 823, 209, 210, 206/219, 575, 235, 81, 1.8, 1.9, 486, 557, 206/558, 559, 562, 563, 564, 565, 223, 206/229; 434/81, 84, 98, 100, 103; D19/103, 105

See application file for complete search history.

(56) References Cited

U.S. PATENT DOCUMENTS

| | | | | | |
|---|---|---|---|---|---|
| 1,391,028 | A | * | 9/1921 | Werntz | 206/1.8 |
| 2,107,239 | A | * | 2/1938 | Eckhoff | 206/1.8 |
| D150,279 | S | * | 7/1948 | Wies | D28/76 |
| 3,441,033 | A | * | 4/1969 | Flax | 132/295 |
| 3,482,728 | A | * | 12/1969 | Flax | 220/525 |
| 3,786,913 | A | * | 1/1974 | Crawford | 206/1.8 |

(Continued)

FOREIGN PATENT DOCUMENTS

| | | | | | |
|---|---|---|---|---|---|
| GB | 2335164 | A | * | 9/1999 | B44D 3/02 |

*Primary Examiner* — Vanitha Elgart

(74) *Attorney, Agent, or Firm* — Clinton H. Wilkinson; Charles A. Wilkinson

(57) ABSTRACT

A cosmetic application tool and container system and method for use by both professional makeup artists and individuals and facilitates the preparation of preparing custom cosmetic colors and blends and then preserving samples of such custom blends, including a palette and a storage receptacle incorporating an alignment system for automatically aligning the components of the system in a compact storage arrangement.

12 Claims, 4 Drawing Sheets

(56) References Cited

U.S. PATENT DOCUMENTS

| | | | | | |
|---|---|---|---|---|---|
| 3,815,265 | A * | 6/1974 | DePauw | 434/103 |
| 4,421,127 | A * | 12/1983 | Geer | 132/294 |
| 4,807,773 | A * | 2/1989 | Tsai | 220/4.27 |
| 4,815,608 | A * | 3/1989 | Silberberg | 132/295 |
| 4,884,680 | A * | 12/1989 | Israel et al. | 206/457 |
| 4,901,846 | A * | 2/1990 | Lehman | 206/1.8 |
| 4,930,529 | A * | 6/1990 | Whitney | 132/73 |
| 5,769,234 | A * | 6/1998 | Gueret | 206/581 |
| 6,123,198 | A * | 9/2000 | Pflueger et al. | 206/581 |
| 6,145,515 | A * | 11/2000 | Wu | 132/295 |
| 6,189,698 | B1 * | 2/2001 | Asser | 206/581 |
| 6,192,892 | B1 * | 2/2001 | Resler | 132/200 |
| 6,338,349 | B1 * | 1/2002 | Robinson et al. | 132/200 |
| 6,540,083 | B2 * | 4/2003 | Shih | 206/581 |
| 6,739,345 | B2 * | 5/2004 | Stanley, III | 132/200 |
| 7,047,983 | B2 * | 5/2006 | Manougian et al. | 132/294 |
| 7,165,559 | B1 * | 1/2007 | Goodman | 132/294 |
| 7,219,801 | B2 * | 5/2007 | Christian | 206/581 |
| 7,563,098 | B2 * | 7/2009 | Whitman | 434/98 |
| 7,740,370 | B2 * | 6/2010 | Campbell et al. | 362/135 |
| 7,819,125 | B2 * | 10/2010 | Maelstaf | 132/293 |
| 2006/0108251 | A1 * | 5/2006 | Sherrer et al. | 206/459.5 |
| 2006/0188850 | A1 * | 8/2006 | Mills | 434/100 |
| 2009/0166246 | A1 * | 7/2009 | Haloulos et al. | 206/581 |
| 2010/0089793 | A1 * | 4/2010 | Plassmeyer | 206/581 |
| 2010/0132734 | A1 * | 6/2010 | Mills | 132/294 |
| 2011/0073130 | A1 * | 3/2011 | Reynolds | 132/296 |
| 2011/0155160 | A1 * | 6/2011 | Haloulos et al. | 132/200 |
| 2011/0155629 | A1 * | 6/2011 | Debauge et al. | 206/581 |
| 2011/0265809 | A1 * | 11/2011 | Jeon | 132/200 |
| 2013/0133686 | A1 * | 5/2013 | Shteysel | 132/314 |
| 2013/0319443 | A1 * | 12/2013 | See | 132/200 |

* cited by examiner

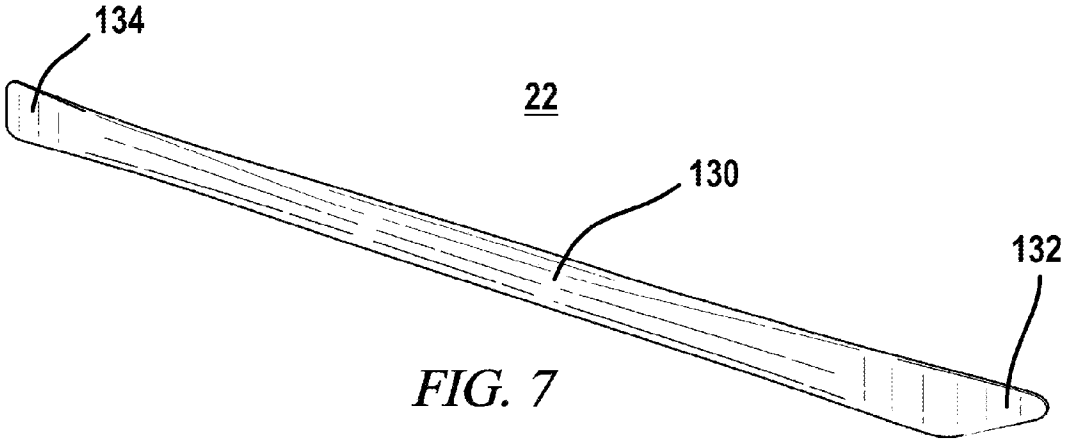
FIG. 7
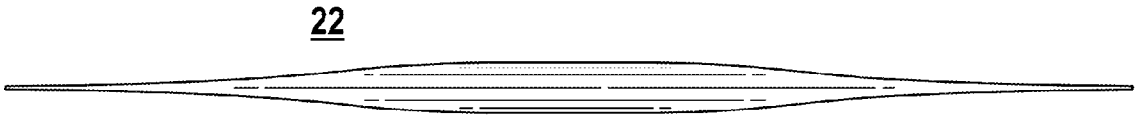
FIG. 8
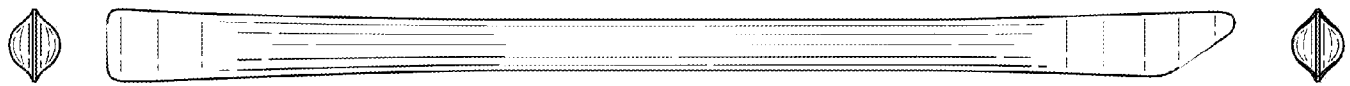
FIG. 9
FIG. 10
FIG. 11
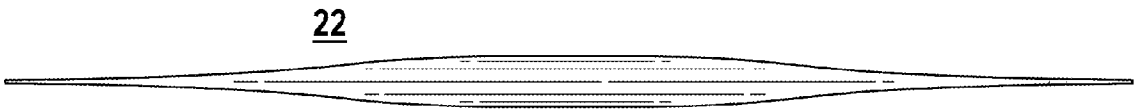
FIG. 12

COSMETIC APPLICATION TOOL AND CONTAINER SYSTEM AND METHOD

FIELD OF THE INVENTION

The present invention relates to cosmetic application tools, aids, and systems, and more particularly to a self-contained cosmetic application tool system and method for color matching and blending cosmetics and container system for preserving and recalling customized cosmetic blends.

BACKGROUND OF THE INVENTION

Professional makeup artists are accustomed to working in fast-paced environments such as in the television, film, theater, and fashion industries with a wide range of clients, some of which the artist will work with on a regular or recurrent basis. With the advent of new technologies such as high-definition television and high resolution digital camera and video, the need for professionally blended face and body makeup for persons appearing in film and video is greater than ever, as these new technologies will tend to exaggerate any flaws. A considerable amount of time is spent by makeup artists in initially selecting and then blending and matching cosmetics in order to achieve a desired look or effect. After consulting with a client, the makeup artist will create a customized makeup plan or regimen for the client, the particulars of which will depend upon factors such as the client's natural skin color or tone, facial structure, body type, lighting considerations, setting, the desired character, and others.

Once a suitable cosmetics application plan is prepared for a client, it is equally important that the makeup artist be able to recall the custom created blends and skin tone matches in the future without having to repeat the entire matching and blending process from scratch. Professional makeup artists will usually try to save a small sample of a custom blended makeup shade or combination on whatever material is available at the time, such as on an index card or the like. However, if a cosmetics blend such as a foundation or concealer is mixed on the back of the makeup artist's hand, or on a palette that will be cleaned for use with another client, often the makeup artist will be too busy to properly preserve such a sample. In addition, even where a sample or samples of a custom makeup blend or mixture are initially saved for one or more clients, if not properly marked, it can be difficult to later associate individual samples with a particular client. In addition, if not collected and stored in an organized and safe manner, it is more likely the samples will become contaminated or destroyed. Unfortunately, then the matched cosmetics must be recreated either from memory or from scratch at a later appointment or session with a client, which is both inconvenient and wastes the time of both the artist and client, not to mention reflecting negatively on the makeup artist. Individuals who mix their own cosmetics have similar difficulty in preserving color matched cosmetic blends.

The use of palettes by makeup artists for mixing makeup colors and textures is known in the industry. A palette typically will have a flat surface or work area on which small quantities of different cosmetics are placed and then mixed or blended to achieve the desired shade or color. After the proper mixture is achieved on the palette, the cosmetic is then applied to the user's skin. In addition to providing a mixing surface, as a hygienic consideration the palette serves as an intermediate surface which prevents possible contamination of a cosmetic supply by natural oils from the user's skin, which if transferred directly from the original package to the skin by a brush or sponge could chemically alter the cosmetic.

Transfer of skin bacteria or other cross-contamination between separate containers and between clients is also limited by use of a palette.

Palettes are especially appropriate to use during mixing of liquid formulas such as foundations or lotions, as well as cream formulas, such as cream concealers or lipsticks. The use of a palette also helps streamline the process of makeup application when mixing formulas are necessary because all of the liquid or cream formulas may be placed on the palette instead of taking the liquid or cream formulas out of the bottle or container every single time. It should be noted, however, that palettes are not limited to being used with liquid or cream formulas, and can be used to mix or hold any type of makeup medium including but not limited to pressed and loose powders, eye shadows, and blush as well.

U.S. Pat. No. 5,277,302 issued to Seisa sets forth a combination paint palette and storage device which includes a generally planar palette base having a thumb aperture and hand grip defined therein. The palette base further defines a plurality of paint mixing recesses and supports a rotating wheel color mix display chart. In addition, a plurality of paint applicators are received and supported within a corresponding plurality of applicator caps. The applicator caps are secured to the palette base in a ball and socket arrangement using a corresponding plurality of simulated paint deposits which are color coded to the applicator paint color. A storage bracket is supported upon the undersurface of the planar palette base and accommodates and stores a plurality of paint media sheets.

An "acrylic mixing palette" prior art non-patent literature reference discloses a makeup mixing palette including a transparent acrylic slate having a thumb aperture, sized to fit comfortably over the hand of a user. The acrylic mixing palette is also available without the thumb aperture and a personalized version is available as well, whereby the palette owner may put his or her initials on it or the like.

Despite these available tools, there is a longstanding need in the cosmetics industry for a more comprehensive container system that allows professional makeup artists, cosmetologists, and other individuals who blend their own makeup to quickly and easily blend and match cosmetics, and then preserve customized and/or personalized cosmetic blends in a manner such that they can be easily identified for later use. This tool must be self-contained, compact, and must not require significant additional labor on the part of the user. The present inventor has therefore developed such a cosmetic application tool and container system and associated method of use.

BRIEF SUMMARY OF THE INVENTION

The present invention is directed to a cosmetic application tool which generally comprises: a board member having a work surface adapted to receive one or more cosmetic products, said board member constructed of a transparent material enabling direct color matching of the one or more cosmetic products with the skin; a spatula; and a storage receptacle having a removable lid member, an interior surface, a slot in the interior surface for receiving the spatula therein, and a plurality of cosmetic storage wells in which one or more cosmetics products selected and matched using the board member are placed and preserved for future use.

An aspect of the present invention is therefore to provide a system and method for professional makeup artists as well as individuals to easily create custom blends or shades of a cosmetic, match with and then apply to the skin, and then save and preserve for future use and reference a sample of each custom blend prepared for an individual client in an orderly and recordable fashion.

Another aspect of the present invention is to provide in an embodiment a cosmetic application tool system which includes a case adapted to hold and store a plurality of individual cosmetic devices, including a palette for mixing and color matching cosmetics, a mixing spatula, and a receptacle having a plurality of reservoirs in which one or more samples of a selected cosmetic and cosmetic mixture may be placed and preserved for future reference or use.

Another aspect of the present invention is to provide a cosmetics application tool which in an embodiment includes a palette for use by professional makeup artists in preparing, mixing, and blending cosmetics for individual clients, and which facilitates the collection, documenting, preservation, and storage of custom prepared cosmetic blends associated with such individual clients.

In order to achieve the objects above, the cosmetic application tool and collection system of the present invention is provided. The system includes in an embodiment a sealable cosmetics receptacle including one or more wells adapted to receive a selected cosmetic product or blend, a palette have a work surface on which one or more cosmetics is to be placed and/or mixed and then compared to the skin to achieve a skin tone match or other desired color or shade match prior to applying to the skin, and a spatula device for blending the cosmetics and transferring samples to the cosmetics receptacle for future reference and use. The system also includes an alignment means for arranging and organizing the component parts of the cosmetic application tool in a compact configuration in a storage container. In addition, the individual containers may be stackable and include a means for identifying stored cosmetics.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The following Detailed Description is better understood when read in conjunction with the appended drawings. For the purpose of illustrating various embodiments, there is shown in the drawings example embodiments; however, embodiments are not limited to the specific methods and instrumentalities disclosed. In the drawings:

FIGS. 7-12 illustrate a mixing implement for use with the present invention.

DETAILED DESCRIPTION OF THE INVENTION

The following detailed description is of the best mode or modes of the invention presently contemplated. The subject matter of the disclosed embodiments is described with specificity to meet statutory requirements. Such description is merely exemplary in nature and is not intended to be understood in a limiting sense, but to be an example of the invention presented solely for illustration thereof, and by reference to which in connection with the following description and the accompanying drawings, one skilled in the art may be advised of the advantages and construction of the invention.

The inventor has contemplated that the claimed subject matter might also be embodied in other ways, to include different steps or elements similar to the ones described in this document, in conjunction with other present or future technologies. Moreover, although the term "step" may be used here to connote different aspects of the methods employed, the term should not be interpreted as implying any particular order among or between various steps herein disclosed unless and except when the order of individual steps is explicitly described.

The present invention is directed to a cosmetic application tool and container system and method which utilizes a combination of individual components or tools such that the system and method may be used to facilitate selecting, mixing or blending, color matching, applying and then preserving cosmetics and custom blended cosmetic preparations. The cosmetic application tool and container system and method is designed particularly for use by professional makeup artists with their individual clients but can also be used advantageously by nonprofessionals in selecting and applying their own cosmetics.

Figure 5:
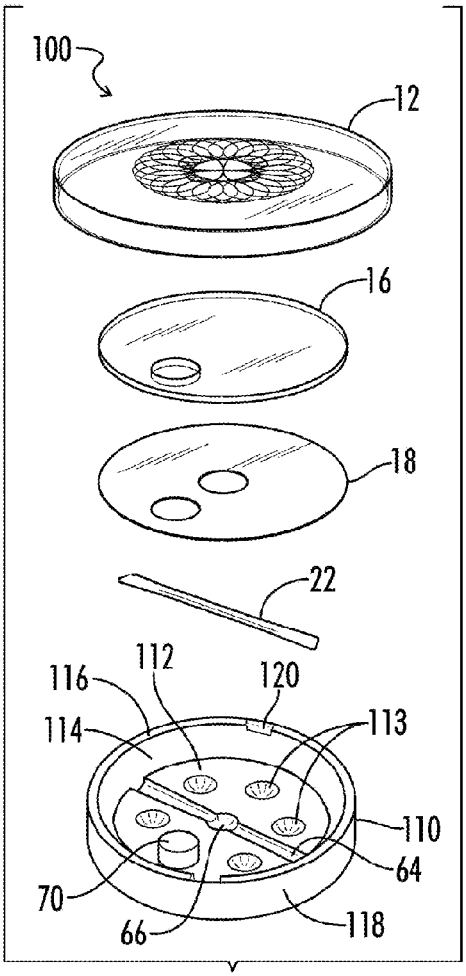
FIG. 5 illustrates an exploded view of another embodiment of the present invention.
Figure 6:
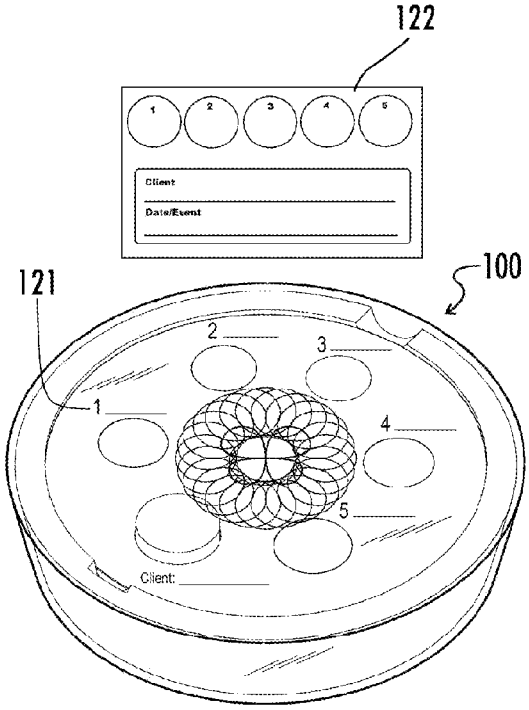
FIG. 6 illustrates the embodiment shown in FIG. 5 in an assembled configuration.

FIGS. 1-4 illustrate an exemplary embodiment of the cosmetic application tool, system, and method of the present invention, while FIG. 5-6 illustrate another exemplary embodiment thereof, and FIGS. 7-10 illustrate a preferred spatula member for use with the invention. Referring now to FIGS. 1-4, there is shown the primary components of an exemplary embodiment of the application tool and system 10, which includes a substantially oval-shaped storage case having a cover or lid section 12 and a main storage section 14, a cosmetics mixing palette or board 16, a cover palette sheet 18, a cosmetics and/or makeup preserving receptacle 20 for preserving selected cosmetics including custom blends, a mixing implement such as spatula member 22, and a storage compartment 24.

Sections 12 and 14 of the storage case form a two-part container for holding the other components of the cosmetic application tool and system 10 in a logical, sequential, and nested relationship. Cover or lid section 12 has an upper wall 26 and a peripheral downwardly depending sidewall 28, while main storage section 14 has a bottom wall 30 and an upwardly depending sidewall 32. The outer diameter of sidewall 32 of storage section 14 is slightly less than the inner diameter of sidewall 28 of cover section 12 such that sidewall 28 of cover section 12 fits snugly over sidewall 32 of main storage section 14 to close the storage case. When the storage case is open, in one embodiment the cover section 12 can be secured over the main storage section 14 so that the upper wall 26 of cover section 12 extends over bottom wall 30 of main storage section 14 and the sections remain associated during use of the components of the invention. In another embodiment, the top and bottom sections 12 and 14 of each storage case are provided with a unique identification means or marking by which the sections can be identified, which is particularly useful where a professional makeup artist is working with several clients at the same time in an crowded dressing room environment or the like where the sections might otherwise become mixed and accidentally misassociated. In another embodiment, all of the components of the invention are provided with such an identification means or marking.

Top and bottom case sections 12 and 14 may be formed of clear PVC (polyvinyl chloride), and are preferably reusable as a storage case for the other components of system 10. In one embodiment, case sections 12 and 14 preferably have a thickness of at least about 0.4 mm PVC; it will be understood, however, that case sections 12 and 14 can have greater or lesser thicknesses, but in all cases should be sufficiently sturdy to withstand repeated use. In other embodiments, sections 12 and 14 as well as the other components of the invention may be made of other suitable materials or combinations of materials as well as other manners of construction than described herein. Sections 12 and 14 may also have different shapes and dimensions while still falling within the intended scope of the invention. In another embodiment, bottom edge of sidewall 28 of top cover section 12 may include a pair of thumb cuts (not shown) which are designed to aid users in manually removing top cover section 12 from bottom cover section 14. In addition, the circumference of top and bottom cover sections 12 and 14 may have a rolled heat sealed edge finish, and a logo or emblem 34 as well as any other desired identification or decorative indicia may be applied on either the inner or outer surfaces of top and bottom cover sections 12 and 14.

Palette or board 16 has a substantially flat work surface 36 and an opposite surface 37. Surface 36 is intended to serve as a work area on which one or more cosmetic products is placed and mixed as needed. Surface 36 also serves as an intermediate surface on which the cosmetic products are placed and blended prior to being applied to the user's skin, preventing contamination of the cosmetics supply containers. Palette 16 also includes an aperture 38 at a position offset from the center of the palette. In a preferred embodiment, palette 16 is round and made of a clear PVC material so that it can be held with underside 37 against or in close proximity to the area of the client or user's skin where the makeup is to be applied, which allows cosmetics placed on work surface 36 to be more easily compared and matched with the user's skin tone. Aperture 38 serves as a thumbhole in which the user's thumb may be inserted when holding and grasping palette 16, whereby the user's fingers are positioned against the outer diameter 40 of palette 16, typically spaced apart on the side surface opposite aperture 38. In addition, as discussed in greater detail below aperture 38 is used as an alignment aperture when the components of system 10 are arranged in a stacked or storage configuration in storage compartment 24.

Receptacle 20 has an upper surface 42, a bottom surface 44, a peripheral edge 46, a center aperture 48, an alignment and thumb receiving aperture 50, and a plurality of spaced-apart reservoirs or wells 52. In one embodiment, receptacle 20 is made of PVC plastic, with center hole 48 and aperture 50 being die cut. Center hole 48 is intended to aid the user in manually removing receptacle 20 from storage compartment 24 as it provides an opening in which the user can insert a finger and then apply a manual upward lifting pressure with such finger on lower surface 44 of receptacle 20. Receptacle 20 in one embodiment has substantially the same diameter as palette 16, and aperture 50 is positioned on receptacle 20 so that it can be aligned with aperture 38 of palette 16. Aperture 50 thus also serves alternatively as a thumb support when holding receptacle 20 and as an alignment aid when receptacle 20 is in a storage position in compartment 24.

Storage compartment 24 in one embodiment is also preferably made of PVC plastic, and includes an interior floor section 53 surrounded by a first inner wall section 54. A ledge 56 is formed around the upper edge of first inner wall section 54, which ledge 56 joins between first inner wall section 54 and a second inner wall section 58 which extends upwardly from ledge 56, terminating at rim 60. Rim 60 joins between the upper edge of second inner wall section 58 and outer surface 62 of compartment 24. An elongated slot 64 is formed in floor section 53 of compartment 24 and is dimensioned to receive a spatula device 22. In one embodiment, spatula 22 is held in slot 64 by a press or friction fit. A thumb tab 66 is preferably provided in floor section 53 and is associated with slot 64 to aid the user in gripping and manually removing spatula 22 from slot 64. A plurality of spaced apart debossed areas 68 are also provided in floor section 53 surrounding slot 64. Each debossed area 68 is positioned and sized to receive one of the wells 52 in cosmetics receptacle 20 when the receptacle 20 is stored in compartment 24. Finally, an alignment tab 70 projects upwardly from floor section 53, preferably to approximately a height slightly less than the height of rim 60. Spaced apart cutouts 72 are also provided in the rim 60 to aid in removing the components of the system such as palette 16, cover or lid member 18 and cosmetics receptacle 20 from compartment 24.

Figure 2:
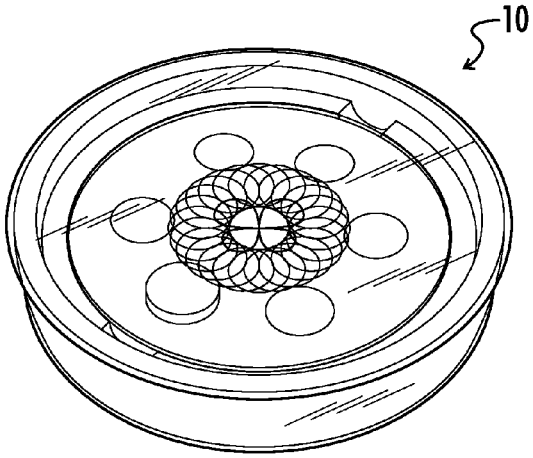
FIG. 2 illustrates the embodiment shown in FIG. 1 in an assembled configuration.
Figure 3:
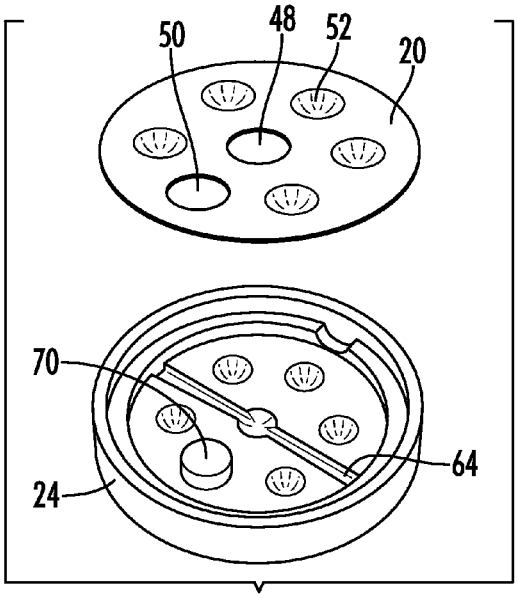
FIG. 3 illustrates a close-up view of the separate cosmetics tray and component storage tray.
Figure 4:
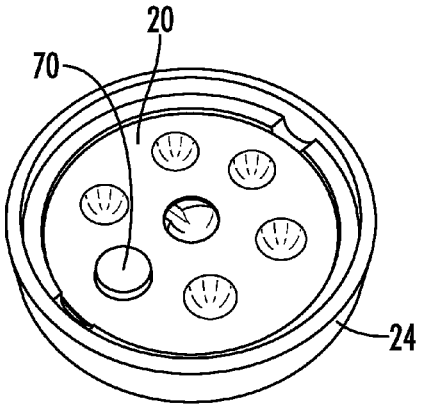
FIG. 4 illustrates the cosmetics tray and component storage tray assembled.

It will be evident from FIG. 2 that storage compartment 24 is adapted to receive sequentially spatula 22, followed by cosmetics receptacle 20, cover 18, and palette 16 in a neat and orderly fashion such that these components of system 10 can be easily and individually accessed for use and then stored again in a compact manner for future use, while at the same time providing the user with a tool for easily preserving samples of cosmetics used with a client, including any customized cosmetic blends or mixes prepared.

More particularly, the cosmetic guide tool includes an alignment system, in which in a storage position, spatula 22 is placed in slot 64 of storage compartment 24, followed by receptacle 20. Aperture 50 of cosmetics receptacle 20 is inserted over alignment tab 70 of storage compartment 24, automatically aligning each of the wells 52 of receptacle 20 with one of the debossed areas 68 of storage compartment 24. Wells 52 and debossed areas 68 fit together in a nested configuration, with the lower surface 44 of cosmetics receptacle 20 resting on or in close proximity to interior floor surface 53 of storage compartment 24, and with outer edge 46 of receptacle 20 adjacent first inner wall section 54 of storage compartment 24.

In another embodiment, ledge 56 may be eliminated from storage compartment or tray 24 such that there is a single inner wall section extending from interior floor section 53 to rim 60. In addition, alignment tabs may be spaced apart and juxtaposed extending inwardly on the inner wall section to aid in centering the other components of system 10 in storage compartment 24.

Figure 1:
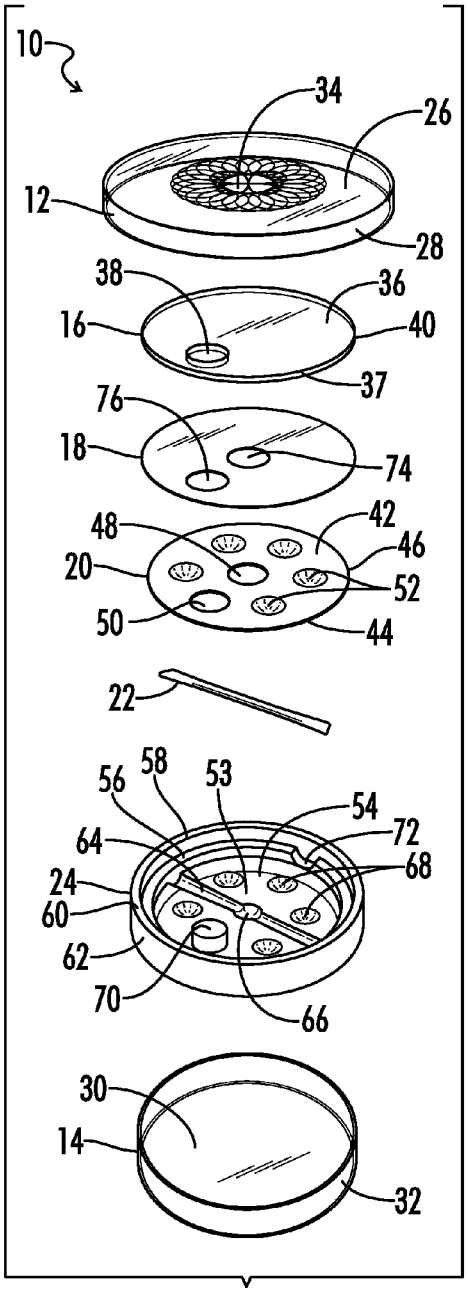
FIG. 1 illustrates an exploded view of an embodiment of the cosmetic application tool and system of the present invention.

Storage compartment cover 18 is placed on top of cosmetics receptacle 20 in storage compartment 24, with its lower surface resting on flat upper surface 42 of receptacle 20. Cover 18 is provided to prevent saved cosmetics mixtures and formulations placed in one of wells 52 of cosmetics receptacle 20 from contacting the underside of palette 16, and in addition to inhibit the saved cosmetics from drying out or deteriorating. Cover 18 is received in first inner wall section 54 of compartment 24, and as shown in FIG. 1 also includes a center hole 74 which serves a dual function both to facilitate its manual removal from receptacle 20, and as an alignment aperture 76 which fits snugly over tab or post 70 of storage compartment 24, ensuring that each of the wells 52 is covered. Palette 16 is then inserted in storage compartment 24 resting partially on ledge 56 and on cover 18, its weigh aiding in holding cover 18 in contact with storage compartment 24, and with edge 40 surrounded by second inner wall section 58.

The components of system 10 then may be inserted in the storage case, with compartment 24 being dimensioned such that outer wall 62 is snugly received against the inner surface of sidewall 32 of bottom cover section 14, after which top cover section 12 is fitted over bottom cover section 14, forming a case around the components of tool 10. Alternatively, compartment 24 may be placed in section 14 of the storage case prior to insertion of the components in the manner described above.

In use, a professional makeup artist will designate at least one of the cosmetic application tools for use with each client, makeup project, cosmetic application, or the like. The storage case is compact and thus a number of cases can be easily carried in a single bag or the like to a makeup application job location or session. First the top section 12 of the storage case is removed from bottom section 14, after which palette 16 is removed from the case. Storage tray cover 18 is removed next, followed by vacuum tray 20 and spatula 22. During the makeup application design or blending process, the user will typically transfer one or more cosmetics products on to palette 16, which can be a primer, concealer, foundation, bronzer, blush, eye primer or eye shadow, lip color products, or any other desired makeup or cosmetic product. Where the user is trying to achieve a particular tone or color, the cosmetics may be prepared for application on the skin by mixing or blending two or more shades or textures of a cosmetic on palette 16 using spatula 22. Palette 16 is clear, which allows it to be repeatedly held close to or directly against the skin of the user or client of the user, in order to better match the mixed cosmetics with a particular skin tone. Adjustments to the shade of the cosmetic can be made as needed by adding more of a particular shade cosmetic to the blend. Several different blends for different parts of the face or body will typically be prepared, depending upon what parts of the skin are exposed.

After the cosmetics for a user client have been satisfactorily selected, blended, and matched, cosmetic application tool 10 allows samples of such cosmetics to be easily saved and preserved for future reference and reuse by the makeup artist with the client. Spatula 22 is used to transfer the remaining amount or at least a sample of each selected or custom blended cosmetics from palette 16 into one of the wells 52 of receptacle 20. As a result, the matched blends can be recalled and if desired used or modified at a later date, and at a minimum serve as a record of a previous cosmetic application and as a color guide for future cosmetics applications with the client. In addition to use by professional makeup artists and cosmetologists, cosmetic application tool 10 is also well suited for use by individuals who select, create and then wish to save their own custom makeup blends. In one embodiment, the makeup artist will label each of the wells as to the location on the body the saved product was used, as well as if desired the name or names or other identifying indicia for the products.

FIGS. 5 and 6 illustrate another embodiment of the cosmetic application tool of the present invention. In this embodiment, cosmetic application tool 100 includes a receptacle 110 which combines cosmetics receptacle 20, storage compartment 24, and bottom cover section 32 described above with reference to FIGS. 1-4 into a single receptacle 110 in which palette 18 and spatula 22 are stored. In addition, debossed areas 113 in interior floor section 112 rather than receiving wells 52 of receptacle 20 as in the previously described embodiment, in the present embodiment serve as the wells in which selected and custom blended cosmetics are to be directly stored. Receptacle 110 also includes a slot 64 in which spatula 22 is stored, with cutout 66 operably associated with slot 64 to aid the user in removing spatula 22 from slot 64. Inner sidewall 114 extends upwardly from interior floor section 112, where it meets rim 116 which connects between inner sidewall 114 and outer sidewall 118. A pair of cutouts 120 is also provided in rim 116 which aid the user in removing the components of tool 100 from receptacle 110.

Cover 18 in the presently described embodiment fits on receptacle 110 with its peripheral edge in close contact with inner wall 114, while palette 16 is then inserted in receptacle 110 on top of cover 18. In addition, top cover 12 is dimensioned to fit directly over outer sidewall 118 of receptacle 110, rather than over a separate bottom cover as described in the previous embodiment. It will be evident that the presently described embodiment requires a lesser number of components and less material to manufacture than the previously described embodiment, and further is less costly to manufacture, while still providing a similarly unique and innovative cosmetic application tool which facilitates the mixing, blending, and then preserving of selected and custom cosmetic blends prepared either by a professional makeup artist or by an individual user at home. In another embodiment, storage tray 20 and compartment 24 are combined into a single unit, while bottom cover section 32 remains separate.

In another embodiment of the invention, cosmetic application tool 10 includes a means for identifying the individual client with which each tool is used, as well as for recording other basic information such as the date and event where the matched cosmetics were selected. In addition, in another embodiment an area for recording the names and shades of each of the cosmetics used selected or blended is also provided. In this instance, each of the wells 52 may be given an identifying number such as one through five 121, and the area for recording such information will have matching numbers. The identification means may be provided with cosmetic application tool 10 in different ways, such as a separate preprinted sheet 122 as an additional component included with tool 10, or as a preprinted label or labels which can be adhered to one of the components of tool 10 such as the underside of storage tray 20. By recording more specific information about the particulars tones or products used to make a blend or shade, it will be easier for both professional makeup artists as well as individuals to recreate a blend. In another embodiment, a phone app may be provided for use by professional makeup artists in combination with the cosmetic application tool which can be used to input and store in a database client information and notes related to the custom cosmetics prepared for each client, as well as a way for associating each record with one or more of the cosmetic application tool devices of the invention.

In another embodiment, cover 18 may be sealingly engaged to storage tray 20 in a manner which provides an airtight seal over wells 52 in order to better preserve the cosmetics placed in such trays. For example, a flexible sealing ring or the like may be provided on the lower surface of cover 18, which is aligned with a matching shallow channel in the surface of tray 20 surrounding the wells 52, or alternatively an adhesive sealing means surrounding the wells may be provided. In another embodiment, cosmetic application tool 10 is designed to be readily stackable with cases of the same design. Professional makeup artists in particular having dozens or even hundreds of clients will over time develop a library of cosmetic application tools 10, one for each client or makeup session the resulting blends of which it is desired to save for possible future use. Having the cosmetic application tool 10 stackable will therefore facilitate each of storage and organizing a library of tools 10.

FIGS. 7-12 illustrate a preferred embodiment of the spatula 22 of the present invention. As shown, the spatula 22 has an elongated body 130 with first and second ends 132 and 134, respectively. The elongated body is rigid and has a cylindrical configuration, which flattens and becomes more flexible as it reaches the first and second ends. The first end 132 has an angular shape, with a flattened diagonal edge, which is rounded off at its corners to avoid having sharp edges. The second end 134 has a square-like shape which is also rounded off at the corners.

The two different shapes and angles provided by the first and second ends 132 and 134 help make it easier for the professional makeup artist or other person preparing and applying makeup to choose to use either the first end 132 or second end 134 of the spatula 22 based on what feels more comfortable to him or her when holding the spatula 22 by its elongated body and depending on the use. The smoothed, rounded out corners of the first and second ends 132 and 134 are angled to aid in transferring solid cosmetics from a bottle or container on to the palette 16, and then blending or mixing cosmetics on the palette surface. The flattened first and second ends 132 and 134 are composed of a material that is flexible, which may be a flexible plastic, and can bend when pressed against a surface with a relatively minimal amount of manual force. On the other hand, the elongated body is more rigid, so that the spatula 22 may be held in a steady manner by the applier of makeup.

Spatula 22 may be composed of a single molded piece of material or several distinct pieces connected together. In a preferred embodiment, the spatula 22 is composed of a single piece of plastic polymer, and has a length of about 14 centimeters. In another embodiment, the widths of the first and second ends 132 and 134 are sized between about 0.5 centimeters to 1.0 centimeters. In another embodiment, the spatula's 22 the first end 132, though rounded at the tips and corners, forms at an angle of approximately 45 degrees. In another embodiment, a logo may be imprinted on or along the elongated body.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A container system comprising:

a) a palette having a work surface adapted to receive one or more cosmetic products, said palette constructed of a transparent material enabling direct color matching of one or more cosmetic products placed on the palette with a skin color or tone;

b) a mixing implement;

c) a storage receptacle having a removable lid section, a bottom interior surface, an outer sidewall, an elongated slot formed in the bottom interior surface for receiving and storing the mixing implement therein, an area in said receptacle for receiving and storing the palette between the bottom interior surface and outer sidewall, and a plurality of cosmetic storage wells in which one or more cosmetic products selected and matched are placed to be preserved for future reference;

d) a cover member dimensioned to be inserted in the storage receptacle in a position covering the cosmetic storage wells; and e) an alignment system for properly aligning the palette and cover member when placed in the storage receptacle, said alignment system including a post projecting upwardly from the bottom interior surface of the storage receptacle, and apertures provided in each of the palette and cover member offset from a center position into which apertures the post projects when the palette and cover member are placed in the storage receptacle.

2. The container system of claim 1 additionally comprising a means for labeling the nature of the cosmetic products placed in each of the storage wells.

3. The container system of claim 2 additionally comprising a means for identifying a client or user of the container system.

4. The container system of claim 1 in which the cover member provides an airtight fit over the plurality of cosmetic storage wells.

5. A system for preparing and preserving for later use a quantity of one or more custom selected cosmetics comprising:

a) a mixing implement;

b) a receptacle having a floor section including a plurality of wells each adapted for storing therein a quantity of a custom selected cosmetic mixture, an elongated groove in the floor section adapted for storing the mixing implement therein, and an alignment guide post extending upwardly from said floor section;

c) a cover member being securable in said receptacle and having an alignment aperture offset from the center of said cover member which is fitted over the alignment guide post when the cover member is placed in said receptacle;

d) a board member having a flat surface for holding and mixing one or more cosmetic products using said mixing implement, said board member adapted to be received in said receptacle and having an alignment aperture offset from the center of said board member which is fitted over said alignment guide post when the board member is placed in said housing;

e) a top cover securable to said receptacle; and f) a system for identifying and labeling a cosmetic mixture stored in each of said plurality of wells in the receptacle, the date the cosmetic mixture was prepared, and other client or user information.

6. The system of claim 5 in which the alignment aperture in the board member also serves as a thumbhole for holding said board member.

7. The system of claim 6 additionally comprising a main storage container in which said receptacle is placed.

8. A cosmetic application tool for use by professional makeup artists for preserving and recalling custom cosmetic blends prepared for their clients comprising:

a) a palette on which custom cosmetic blends can be mixed and matched with the skin, the palette having a dual purpose manual gripping and alignment aperture offset from a center position, b) a storage receptacle having a main storage section and a removable cover member including an alignment aperture offset from a center position, a plurality of wells adapted for separating, holding, and storing one or more custom cosmetic blends selected for a client, and an alignment guide post extending upwardly from a bottom interior surface of the storage receptacle for receiving the alignment apertures of the cover member and palette and automatically aligning the cover member and palette in the storage receptacle, and c) indicia on the storage receptacle or cover member for identifying the plurality of wells.

9. The cosmetic application tool of claim 8 in which the palette is made of a transparent material.

10. The cosmetic application tool of claim 9 additionally comprising a mixing implement which is storable in the storage receptacle.

11. The cosmetic application tool of claim 10 in which the mixing implement includes an elongated body having first and second ends, the first end having a flattened diagonal shape and rounded corners, and the second end having a flattened square shape with rounded corners.

12. The cosmetic application tool of claim 8 wherein said indicia includes additional information about a client and identifying custom cosmetic blends placed in the storage receptacle.

* * * * *